US005261670A

United States Patent [19]

Mull

[11] Patent Number: 5,261,670

[45] Date of Patent: * Nov. 16, 1993

[54] PUTTING STROKE DEVELOPER

[76] Inventor: Richard F. Mull, 2745 Elderberry Ct., Bloomington, Ind. 47401

[ * ] Notice: The portion of the term of this patent subsequent to Mar. 31, 2009 has been disclaimed.

[21] Appl. No.: 860,696

[22] Filed: Mar. 31, 1992

Related U.S. Application Data

[60] Division of Ser. No. 640,536, Jan. 15, 1991, Pat. No. 5,100,147, which is a continuation of Ser. No. 397,231, Aug. 23, 1989, abandoned.

[51] Int. Cl.[5] ..... A63B 57/00

[52] U.S. Cl. ..... 273/177 B; 273/177 R; 273/187.1; 273/181 K

[58] Field of Search ..... 273/32 R, 32 B, 32 H, 273/34 R, 35 R, 176 F, 176 B, 176 FB, 176 H, 177 R–177 B, 179 R, 180, 181 R, 181 J, 181 K, 187.1, 195 R, 87 R, 87 B, 87 C

[56] References Cited

U.S. PATENT DOCUMENTS

| | | | |
|---|---|---|---|
| 1,328,963 | 5/1920 | Rolfe | 273/176 F |
| 1,528,056 | 3/1925 | Herbert | 273/32 R |
| 1,738,265 | 12/1929 | Scanlan | 773/178 R |
| 1,823,487 | 9/1931 | Clear | 273/178 A |
| 2,475,763 | 7/1949 | Vandal | 273/178 A |
| 2,635,879 | 4/1953 | Rath | 273/177 R |
| 3,048,405 | 8/1962 | McCaul | 273/177 R |
| 3,342,495 | 9/1967 | Wasley . | |
| 3,512,262 | 5/1970 | Smyk et al. | 273/177 R |
| 4,017,084 | 4/1977 | Jeffery | 273/34 R |
| 4,114,889 | 9/1978 | Midana | 273/176 F |
| 4,294,450 | 10/1981 | Gallic | 273/178 A |
| 4,368,888 | 1/1983 | Ren | 273/176 FB |
| 4,429,882 | 2/1984 | Stanton | 273/177 R |
| 5,100,147 | 3/1992 | Mull | 273/177 B |

*Primary Examiner*—V. Millin
*Assistant Examiner*—Steven B. Wonef
*Attorney, Agent, or Firm*—Sixbey, Friedman, Leedom & Ferguson

[57] ABSTRACT

A putting stroke developer is comprised of a target element that may be used with and without a putting surface element. Common to all embodiments of the inventive target element is the fact that the target element has a base surface that rests upon a putting surface as well as a vertically oriented, arcuately curved, relatively hard golf ball rebounding surface designed to produce a rebound that will indicate the accuracy of the line and force of a putt relative to the likelihood that the putt would have successfully landed within a regulation golf hole, and that the target element has sufficient mass to resist displacement, in an unsecured state, under the effect of a putted golf ball impacting against the rebounding surface. A putting surface element preferably simulates a putting green surface, and advantageously, is in the form of a mat to enable it to be rolled or folded for compact storage and transport. The mat has placement indicia for locating the target element thereon, and also has evaluating indicia for providing more accurate observational feedback as to the quality of a putt, both as a function of distance and angle of rebound.

16 Claims, 3 Drawing Sheets

PUTTING STROKE DEVELOPER

This application is a division of Ser. No. 640,536, filed Jan. 15, 1991, now U.S. Pat. No. 5,100,147 which is a continuation of Ser. No. 397,231, filed Aug. 23, 1989, now abandoned.

BACKGROUND OF THE INVENTION

1. Field of the Invention

The present invention is directed to the field of devices with which a golfer can practice his or her putting skills. In particular, the present invention is directed to the type of putting stroke developer which provides a target, representing a hole in the green of a golf course, at which golf balls may be putt and to games involving putting skills which use such target devices.

2. Description of Related Art

As is well recognized, putting represents approximately 50% of the total scoring in an 18 hole round of golf on a regulation golf course, so that the ability of a golfer to accurately putt the ball into the hole is critical to success as a golfer. While putting on an actual green or putting green having a regulation golf hole, of course, provides the best practice, for practice at home, the office, or anywhere else away from a golf course or other recreational facility having a putting green, golfers have resorted to a wide range of devices to develop their golf putting stroke, including a tumbler-type glass placed on its side on the floor.

Most devices used as a target for developing one's putting stroke are designed to collect a ball that has been putted. However, many of these devices, due to their configuration or mode of operation, do not give a true indication as to the accuracy of a practice putt, nor do they provide truly meaningful feedback as to the degree to which a putt, that may have been good enough to go into a hole, has deviated from an ideal putt.

In recognition of at least some of the shortcomings of most golf putting practice targets, particularly those of the collecting type, in U.S. Pat. No. 4,429,882 to Stanton, a golf putting target is disclosed that is comprised of a circular base having a diameter that is the same as a hole in the green of a golf course, and a vertical wall that is integral with the base and extends partially around the circumference of the base. The circular base creates an upward sloping ramp that is directed toward the center of the vertical wall and which is flanked on either side of a center line by a ramp that slopes downward toward the respective side of the base. Furthermore, the height of the vertical wall is designed to permit golf balls to jump over it, except at its center where it is high enough to rebound the golf ball if it has not been putt too hard.

As a result, a golf ball putted along the center line of the base of the target of the Stanton patent will travel up the upward slanting ramp surface of the base and contact the vertical wall at the back thereof. From the back of the wall, the ball will be deflected off to one side by one or the other of the downward sloping ramps. On the other hand, a ball that has been putt with insufficient velocity to reach the back wall or which has been inaccurately putted will be diverted to one side by the downwardly sloping ramps and, due to the fact that the back wall tapers downwardly from its midpoint, will jump over the vertical wall, assuming the golf ball does not miss it entirely.

While the golf putting target of the Stanton patent can be useful in developing a golfer's putting skills, it can prove frustrating to the less accomplished putter. Furthermore, a golf putting target of the type disclosed in this patent does not provide sufficient feedback to the putter as to the extent that his putt has deviated from the exact line and force of putt required for an optimized holing of a ball on an actual green, and it is not readily adaptable to use in the playing of a game involving putting.

Golf putting practice devices are also known which combine a rebounding element, at which a ball is putt, and a putting surface element on which it is disposed, indicia by which the quality of the putt can be evaluated from its rebound being provided on the surface element. Examples of such devices are shown in U.S. Pat. No. 3,342,495 to Wasley and U.S. Pat. No. 4,368,888 to Ren. In the Wasley patent, a practice putting device is disclosed wherein a spring is placed across the mouth of a half cup at a height which will cause a ball putted so as to enter the half cup to impact, instead, against the spring and rebound in a direction and for a distance that is a function of the direction and force of the putt. A foam mat to which the half cup is attached has an area marked in front of the half cup which is intended to reflect that a ball stopping in that area would have remained in a standard golf cup, while a rebound beyond that area indicates that the ball would have jumped the standard cup and continued rolling.

In an analogous manner, the golf putting device of the Ren patent affixes a rebounding block to a putting strip. The rebounding block has a layer of heavy, dense material positioned high enough to be struck by the ball and produce an enhanced rebound action. Distance markings are provided on the upper surface of the putting strip for correlating the quality of the putt with the distance of the rebound. The rebound block has a number of planar faces of different widths and the block can be rotatably adjusted so as to bring any one of these faces into a position normal to the path of a golf ball caused to roll along the strip by the putter.

While both of these devices may be amenable to use in playing games involving putting, neither of these devices, whether used merely for individual practice or as a competitive game, are able to provide a truly accurate indication as to whether or not a putt would have been successful inasmuch as no feedback is provided to the putter pertaining to the relative degree of accuracy of the line of the putt. Moreover, versatility of the devices of these patents is constrained by the fact that their rebounding element is not independently usable without the putting mat or strip upon which it is mounted.

Thus, there is still a need for a device that can be used, by itself, to develop one's putting stroke through the provision of feedback as to the putter's proficiency with respect to both the line and force of putt, or with a putting mat bearing appropriate indicia that can be used to heighten the degree of feedback information and/or serve for use in playing of a competitive putting game.

SUMMARY OF THE INVENTION

It is a general object of the present invention to provide a putting stroke developer with which putting may be practiced via a hole simulating target which will provide the putter with observational feedback as to the degree of accuracy of the line (direction) of the putt and the force (distance) of the putt.

In keeping with the preceding object, it is a more specific object of the present invention to create a putting stroke developer target element having a circular face corresponding to the diameter of a golf hole, and sufficient mass and hardness to result in a predictable rebounding of a putted golf ball from the target element without causing displacement of the target element, even though it is merely resting upon the putting surface.

It is a more specific object of the present invention to provide a putting stroke developer target element, of the type mentioned in the preceding object, which may be easily and economically manufactured in any number of manners.

It is yet another object to provide a putting stroke developer which is totally portable and usable on a wide variety of putting surfaces, including a conventional carpet and a putting mat especially designed for use with the stroke developer target element in enabling a more precise observational feedback to be obtained as well as facilitating the playing of a competitive putting stroke developer game.

The above and other objects are achieved in accordance with preferred embodiments of a putting stroke developer in accordance with the present invention which is comprised of a target element that may be used with and without a putting surface element. Common to all embodiments of the inventive target element is the fact that the target element has a base surface for resting upon a putting surface, and a vertically oriented, relatively hard golf ball rebounding surface having rebound characteristics which will cause a golf ball that is putt against the target element to rebound off the rebounding surface in a direction and for a distance which will correspond to the likelihood that the ball would have been successfully putted into a regulation golf hole, and that the target element has sufficient mass (inertial weight) to resist displacement, in an unsecured state, under the effect of a putted golf ball impacting against the rebounding surface.

The target element may be comprised of a solid block of a hard, dense material that constitutes the entire target element, or the solid block may be only one component of a multipart target element. Furthermore, a bumper, coating or the like of an elastic material may be provided, for various reasons, so longer as such is done in a manner that does not affect the predictablity of the rebound to any significant extent.

In the case of a one-piece construction of the target element, the solid block of hard, dense material may be of a cylindric shape having an obliquely angled top surface which slopes upwardly from front to back and upon which target indicia, such as a center line and at least one parallel line at each side thereof, may be marked. On the other hand, a multipart target element may, advantageously, be constructed of a pipe segment forming a cylindrical wall of the target element, upon which the block of hard, dense material may be mounted in the form of a cap. Such a cap may be provided with a plug-in portion which is snugly received in the pipe segment and a dome-shaped top portion which extends upwardly from a top edge of the pipe segment. In the latter case, target indicia marked on top of the dome-shaped top portion can, suitably, be in the form of a center line and at least one additional line at each side thereof with the center line and additional lines running from proximate the top edge of the pipe segment to the apex of the dome-shaped top portion of the block.

The putting surface element in accordance with the present invention, most importantly, should simulate a putting green surface, and advantageously, is in the form of a mat to enable it to be rolled or folded for compact storage and transport. The mat has placement indicia for locating the target element thereon and also has evaluating indicia for providing more accurate observational feedback as to the quality of a putt of a golf ball as a function of both the distance and angle of its rebound from the rebounding surface of the target element.

Preferably, the evaluating indicia are in the form of an arcuate grid-like array formed from a plurality of radially spaced lines which extend circumferentially with respect to the target element, when it is placed on the positioning indicia, and a plurality of circumferentially spaced lines which extend radially with respect to the target element so as to intersect the radially spaced lines, thereby creating zones within which value indicia, such as numbers, may be placed. The indicia are selected to be indicative of the relative likelihood that a putt resulting in a golf ball landing therein after rebounding off of the target element would have been successfully putted into a regulation golf hole.

Additionally, a plurality of putting lines can be marked on the mat with a respective value adjustment factor (e.g., 2X, 3X, etc.) for the numerical indicia being associated with each putting line. This feature enables playing of a competitive game with different scoring values being accorded for balls landing in the same zone that have been putted from different putting lines.

The invention is well suited for fine-honing of a player's putting skills, both in solitary practice sessions and competitive interplay games, yet is also adaptable to numerous modes of manufacture and format in easy and economical manners. It is capable of being utilized indoors or outdoors, and is readily stored and carried about, and it is even possible to simply throw only the target element into one's golf bag for use whenever subjected to a wait out on a golf course, prior to teeing off or the like.

The above and other objects, features and advantages of the present invention will become more apparent from the following detailed description of the preferred embodiments when viewed in conjunction with the accompanying drawings.

DETAILED DESCRIPTION OF THE PREFERRED EMBODIMENTS

Figure 1:
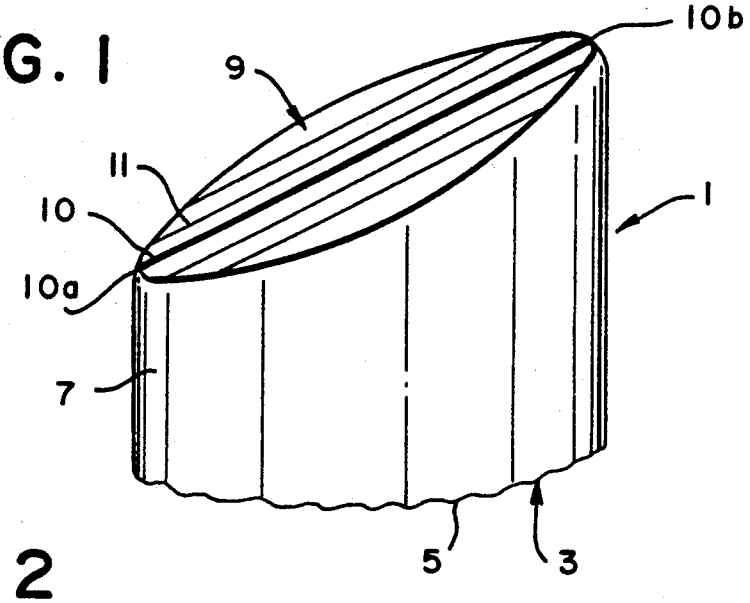
FIG. 1 is a perspective view of a first embodiment of a target element in accordance with the present invention.
Figure 2:
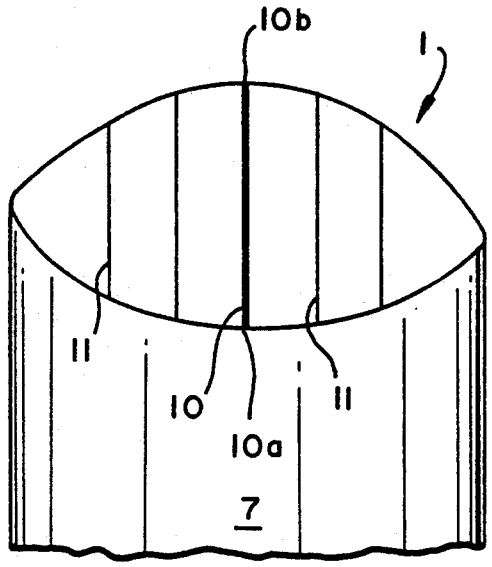
FIG. 2 is a front elevational view of the FIG. 1 embodiment target element.
Figure 3:
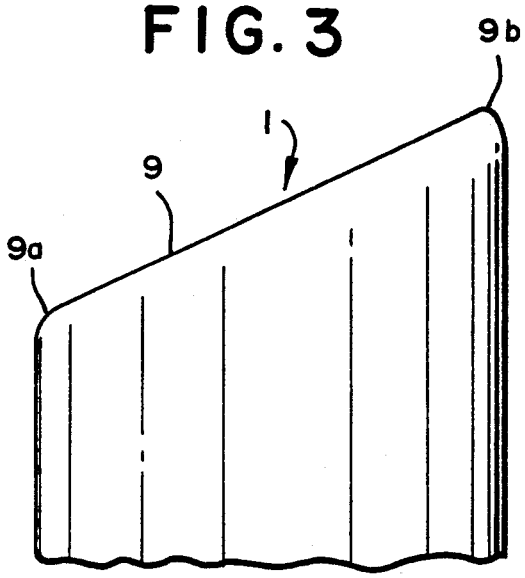
FIG. 3 is a side elevational view of the FIG. 1 target element.

In FIGS. 1-3, a first embodiment of a target element 1, for use as a putting stroke developer with which putting may be practiced, that is of a one-piece construction. Target element 1 has a base surface 3 for resting upon a floor, the ground, a carpet or a specially designed mat (to be described below). The target element has sufficient mass to resist displacement, in an unsecured state, under the effect of a putted golf ball impacting against it. For the purpose of providing the target element with sufficient mass (inertial weight) to resist displacement and to provide a sufficiently hard surface for the putted ball to rebound from in a predictable manner, the target element is, preferably, made of a hard and dense material, such as lead, steel, hard plastic, glass, etc., or a combination thereof. In practice, a target element 1 having perimeter matched to that of a regulation golf hole and a weight of at least 2-3.5 lbs. has proved satisfactory.

However, the resistance of target element 1 to movement can be assisted by providing the base surface 3 with a gripping means 5 for improving sliding resistance. In particular, the gripping means 5 may comprise a surface texturing, such as the corrugated surface texturing shown, and/or a covering of a material having a high coefficient of friction, such as a soft rubber, that could either be thin enough to take on the texturing of the bottom surface, or could be thicker and shaped to provide a textured surface itself; although the covering could be smooth as well.

To provide a target at which a golfer may aim his putt, target element 1 is provided with an obliquely angled top surface which slopes upwardly from front to back, and is marked with target indicia. The target indicia can be in the form of a center line 10, and at least one additional line 11 at each side thereof. The center line 10 and the additional lines 11 are parallel to each other, running from front to back. To facilitate distinguishing of the center line as well as to have an attractive appearance, the center line 10 may be made bolder and/or a different color from the lines 11 on each side of it. The oblique angling of the top surface 9 serves to facilitate viewing of the target indicia and aiming at, in particular, its line 10. A desirable angling of the oblique top surface 9 is achieved if surface 9 rises approximately ½ to 1 inch from the front end 10*a* to the rear end 10*b* of the center line 10.

A relatively hard golf ball rebounding surface is provided by vertically oriented, arcuately curved side wall 7. By "relatively hard" it is not meant that the surface must be inflexible, only that it is able to produce an adequate degree of rebounding in a directionally predictable manner (for example, a soft foam material would be unacceptable in both respects). Thus, as described below, formation of wall 7 is not restricted to the use of hard, dense materials, such as lead, steel, glass, and dense plastics; although such materials are well suited for this purpose.

The rebounding surface provided by the side wall 7, preferably has a curvature of a radius that corresponds to that of a regulation golf hole (which is essentially four inches in diameter). Furthermore, in order to ensure that the rebounding surface provided by the vertically oriented wall 7 is sufficiently high at its low point (which is at end 10*a* of center line 10), the height of wall 7 is preferably about 1½ inches at its low point.

A target element as described above has been found to provide excellent observational feedback as to the degree of accuracy of the line (direction) of the putt and as to the force (distance) of the putt. This results from the fact that the less accurate the line of the putt, the greater will be the angle of the rebound, and because the distance which the ball rebounds is directly correlated to the force at which the ball impacts the target element, i.e., too long a rebound will indicate that the force of the putt was too great and the ball would likely have jumped the cup or have gone too far past the cup for an easy putt coming back. Thus, a perfect putt would be indicated if the ball were to execute a short rebound straight back in the direction of the putt.

Figure 4:
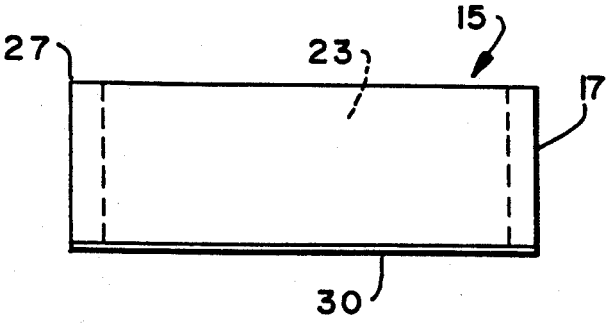
FIG. 4 is a side elevational view of a pipe segment forming a cylindrical rebounding wall of a second embodiment of a target element in accordance with the present invention.
Figure 5:
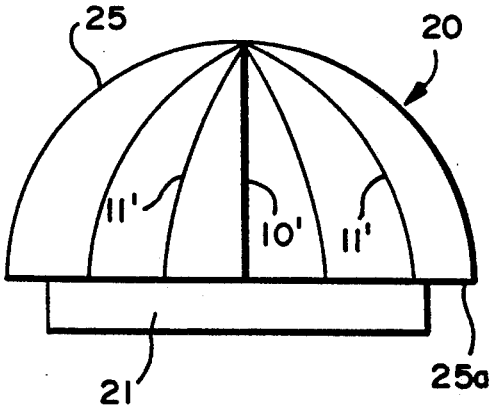
FIG. 5 is a side elevational view of a block having a dome-shaped top portion that forms a cap for the pipe segment of FIG. 4.

FIGS. 4 and 5 illustrate a target element embodiment which is a suitable alternative to the one-piece or solid block target element 1 of the above-described embodiment. The target element of this embodiment comprises a pipe segment 15, having a cylindrical side wall 17 forming the rebounding surface, and a block of material that adds sufficient weight to that of the pipe segment and is formed into a cap 20 for the pipe segment 15. The cap 20 has a reduced diameter plug-in portion 21 that can be permanently or removably mounted within the top end of the interior 23 of the pipe segment 17, and a dome-shaped top portion which extends upwardly from the top edge 27 of the pipe segment 15 when the plug-in portion 21 is mounted in place within the top end of the hollow interior 23 of pipe segment 15.

Similar to the first embodiment, target indicia are provided which comprise a center line 10' and at least one additional line 11' at each side thereof. However, in this case, the center line and the additional lines run from proximate the top edge of the pipe segment (bottom edge 25*a*) to the apex of the dome-shaped top portion 25 of the cap 20. To close the bottom end of the pipe segment 15 as well as to provide improved sliding resistance, gripping means can be provided by a base surface of a textured and/or high friction material 30 that is applied so as to close the pipe segment 15 at its bottom end. For example, a circular rubber disk could be glued to the bottom end of the pipe segment 15. A target element in accordance with the second embodiment would be utilized in the same manner described above, with the same beneficial results.

In certain circumstances, it may be desirable to produce a reduced rebound effect, e.g., to prevent the golf balls from rolling too far when putting on smooth surface have a low rolling resistance in comparison to synthetic or natural turf, or it may be desirable to eliminate the production of noise as the golf balls impact against the rebounding surface. For such purposes, an elastic surface element may be applied to the rebounding surface. Such an elastic surface element may be a solid rubber-like bumper member 31, as found on pin ball machine bumpers (FIG. 6) or could be a rubber band type member 32 (FIG. 7). These members 31,32 should be of a width and positioned to insure contact with a golf ball rolling against the rebounding surface 7,17. Alternatively, a coating of an elastic material can be used covering the rebounding surface, for example, as a continuation of a coating used as the friction material 30.

In any case, it is important that the elastic surface element not affect the predictability of the rebound. This can occur if the elastic element is too soft or is mounted in a manner such that it is unsupported in the area of impact (such as in the manner shown for spring member 15 in the above-mentioned U.S. Pat. No. 3,342,495) so that significant uncontrolled deformation can be produced affecting the angle of rebound, not just the force of rebound.

Any of the above embodiments can be utilized to practice putting on any available surface, whether carpet, grass, synthetic turf, or the like. However, in accordance with a further aspect of the present invention, a putting surface element is provided in order to enable a single golfer to obtain more detailed or accurate observational feedback from use of the target element, as well as to enable the target element to be used by several golfers for the playing of a competitive putting game.

While the putting surface element can be a permanent structure, similar to that of a miniature golf course, or an appropriately covered rigid board-like structure, preferably the surface element in accordance with the present invention will be in the form of an elongated mat 35 that is formed of a flexible material that simulates the putting surface of a golf green, such as a strip of synthetic turf, or a strip of carpet, or other suitably textured material. In this way, the putting surface element formed by the mat 35 can be rolled up into a compact tube that is light in weight and easily transported and stored.

The mat 35 is comprised of three basic areas. In proximity to a first end of the mat 37, the mat has a centrally located placement indicia 39 in the form of, for example, a circle matched to the circumference of the side wall 7, 17 of the target element for use in locating the target element on the mat 35. At a distance from end 37 of the mat 35 is a putting area 40 upon which at least one, and preferably several, putting lines 42 are marked on the mat 35. The third area of the mat 35 is a target area 45 upon which putt evaluating indicia are marked.

The putt evaluating indicia, preferably, comprise a grid-like array formed from a plurality of radially spaced lines 47, which extend circumferentially with respect to the target element when it is placed on the positioning indicia 39, and a plurality of circumferentially spaced lines 49, which extend radially with respect to the target element placed on the positioning indicia 39. The lines 47 and 49 intersect each other so as to create a plurality of scoring zones 50. Each scoring zone 50 is defined between a portion of a respective sequential pair of radially spaced lines 47 and a portion of a respective sequential pair of circumferentially spaced lines 49 disposed therebetween.

Figure 8:
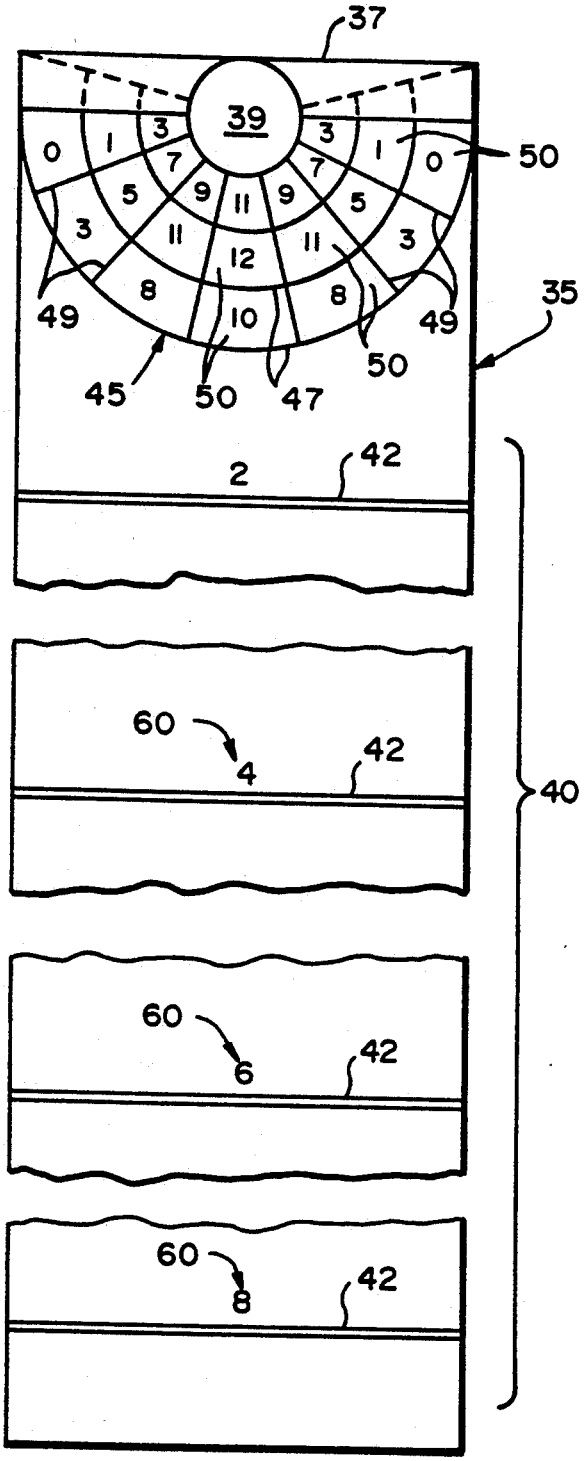
FIG. 8 is a top plan view of a putting surface element in the form of a mat in accordance with the present invention.
Figure 9:
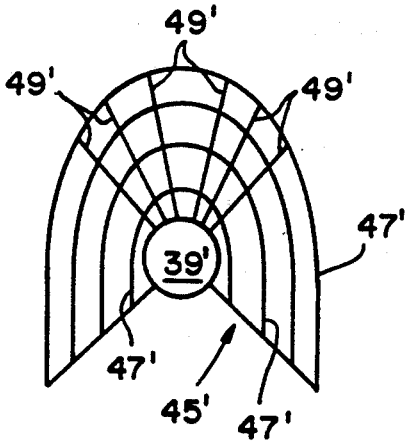
FIGS. 9 and 10 are representations of alternative target areas for use on a surface element in accordance with the present invention.

Additionally, value indicia, such as the numerical point score indicia shown in FIG. 8, is placed in each zone 50; although the value indicia need not be numeric and could be alphabetic or pictorial instead. However, irrespective of the type of indicia utilized, they should be selected so as to be indicative of the relative likelihood that a putt resulting in a golf ball landing in the particular zone, after rebounding off of the target element on the placement indicia 39, would have been successfully putted into a regulation golf hole. Thus, the zones closest to the longitudinal center axis of mat 35 would bear the highest values and the values of the zones would decrease progressively to each side of the most central zones in order to take into consideration the effect of the line of the putt relative to the likelihood of success. Similarly, the values associated with the value indicia would also be adjusted in a radial direction in order to reflect the effect of the force (distance) of the putt relative to the likelihood of success in holing the golf ball. In such a case, the closest zone to the target element may or may not be the highest since it may be desirable, depending upon the rolling characteristics of the surface of the mat and rebound characteristics of the target element, to take into consideration that a nominal rebound might reflect a putt which would possibly have fallen short if it had been made on the green of a regulation golf course.

Figure 6:
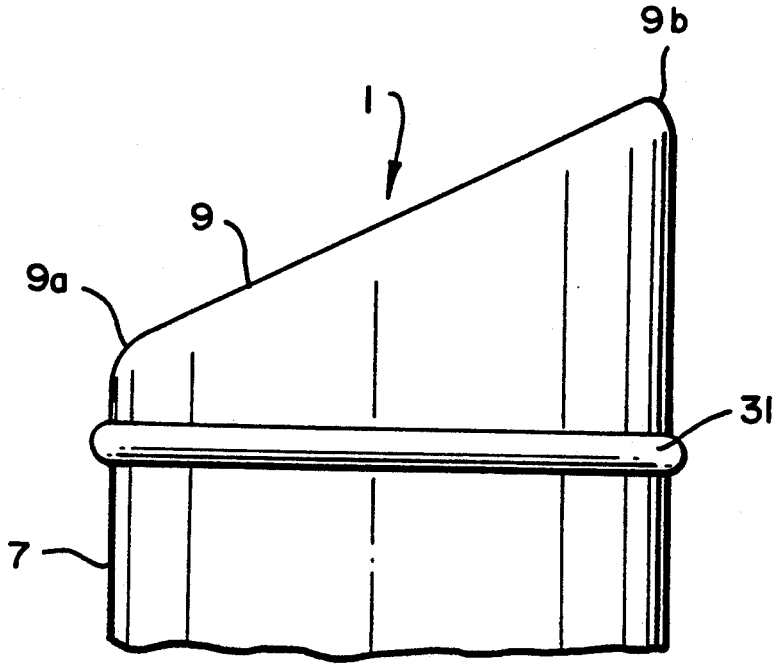
FIGS. 6 and 7 show modifications for providing an elastic surface member on the rebounding surface of the target elements in accordance with the invention.
Figure 7:
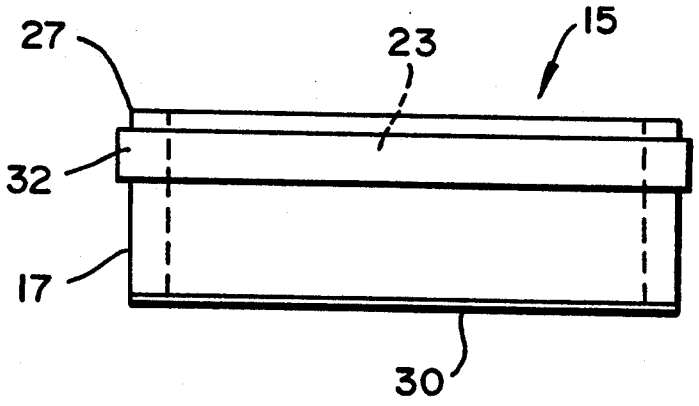

While the circumferentially extending lines 47 are shown as being semicircular in FIG. 6, as represented by the dash lines of this Figure, they may be extended to create additional zones in order to take into consideration "English" that may be applied to a ball or the effect of a "break" in the green that may be simulated by the surface of the mat 35, or in certain circumstances such may prove desireable simply to compensate for the differences between the effects of when a golf ball impacts against a curved surface of an upstanding wall and when the ball passes near the edge of a recess golf hole cup. Likewise, even though the radially extending lines 49 are shown at equally spaced intervals in FIG. 6, such need not be the case, and the same is true for the circumferentially extending lines 47 which need not necessarily be circular segments either.

For example, as shown in FIG. 7, a target area 45′ may be formed from elliptically arcuate lines 47′, the first of which is more closely located to the placement indicia 39′ than the sequential spacing between subsequent pairs of lines 47′ and with the greatest spacing being between the first pair of lines 47′. Similarly, a central most pair of radially extending lines 49′ can be more widely spaced than the next pair of lines 49′ to either side thereof, and with largest zones being created for the marginal zones at each side of the placement area 39′.

However, in all cases, there should be a direct correlation between the value indicia located in any given zone relative to the value of a putt in terms of the likelihood that a ball landing therein after rebounding against a target element would have been successfully putt into a regulation golf hole on a typical putting green. With this in mind, it should also be recognized that based upon the properties of the surface element utilized as well as those of the target element itself, in certain circumstances other target area designs and target elements may more accurately reflect the golfer's putting skills relative to the results that would be obtained on a golf course.

Figure 10:
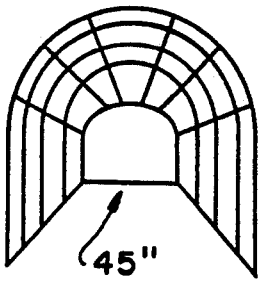
Figure 11:
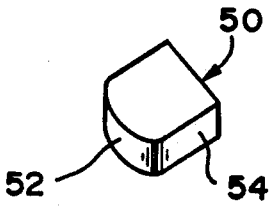
FIG. 11 is a perspective view of a target element for use with the modified target area illustrated in FIG. 10.

For example, FIGS. 10 and 11 show another target area 45″ and a target element 50 for use thereon. In this case, the target element 50 has a rebounding surface 52 that is formed by a partially cylindric front portion of a target body having a rectangular rear portion 54, the width of which is equal to the length of the cord of the partially cylindric front portion defining the rebounding wall 52. The partially cylindric front portion may be semicylindrical or less.

As noted above, preferably a plurality of putting lines 42 are provided at spaced intervals along the length of the mat 35. The closest of these putting lines 42 to the target area 45 should be at least 12 inches away from the end of the target area, with subsequent lines being at any suitable interval for any desired length, such as at two foot intervals for eight feet. Furthermore, to increase the competitive game value, the rules governing scoring based upon the point values in the scoring zones 50 can call for variation of the point value on the basis of a respective value adjustment factor that is a function of the numerical indicia 60 associated with each putting line 42.

For example, in order to enable different scoring values to be accorded for balls landing in the same zone 50 that have been putted from different putting lines, a multiplication or addition factor could be utilized so that the score indicated in the particular zone 50 would have 2, 4, 6 or 8 points added thereto, depending upon the line 42 from which the putt was made, or the point values could be multiplied by 2, 4, 6, 8, etc., or the like. Such a feature adds strategy to the game being played. Advantageously, the numerical indicia utilized for the adjustment factor can be the actual distance of the respective putting line 42 from the target element being aimed at, so that when used simply as a putting stroke developer, the golfer will also know the length of the putt being attempted, as well as the accuracy thereof.

From the foregoing, it should now be readily apparent how the present invention achieves all of the objects set out above, and provides a device that can be used, by itself, to develop one's putting stroke through the provision of feedback as to the proficiency with which a putt has been made, both with respect to the line of the putt and to the force of the putt, and which may also be utilized with a putting mat bearing appropriate indicia to heighten the degree of feedback information and/or for use in playing of a competitive putting game. Furthermore, those of ordinary skill in the art should recognize that the above embodiments and the details thereof are merely representative in nature, the invention being susceptible to numerous variations beyond those described above. Accordingly, the present invention is not intended to be limited to the embodiments disclosed herein, but rather encompasses the full scope of the appended claims.

I claim:

1. A putting stroke developer comprising a target element, forming a means for providing a direct indication of the accuracy of the line and force of a putt of a golf ball as well as the probability that the putted golf ball would have failed to land in a regulation golf hole from the rebound effect of the putted golf ball impacting thereagainst and an indication that the ball would have failed to land in the regulation golf hole whenever the golf ball misses the target element, said target element comprising a base surface for resting upon a putting surface, and a vertically oriented, arcuately curved, relatively hard golf ball rebounding surface, said rebounding surface having a curvature producing a rebound direction directly related to the accuracy of the putt and a width that is substantially the same size as the diameter of a regulation golf hole; and wherein said target element, in an unsecured state, has sufficient mass to resist displacement under the effect of a putted golf ball impacting against said rebounding surface while producing a rebound distance that is directly related to the force of the putt.

2. Putting stroke developer according to claim 1, wherein said target element comprises, at least in part, a solid block of a material selected from the group consisting of lead, steel and glass.

3. Putting stroke developer according to claim 2, wherein the rebounding surface, at least at a height at which a rolling golf ball will impact, is provided with an elastic surface member on said rebounding surface.

4. Putting stroke developer according to claim 2, wherein said target element has an obliquely angled top surface which slopes upwardly from front to back and which is marked with target indicia forming a means for setting the line of the putt.

5. Putting stroke developer according to claim 4, wherein said target indicia comprise a center line and at least one parallel line at each side thereof.

6. Putting stroke developer according to claim 2, wherein said target element is of a one-piece construction.

7. Putting stroke developer according to claim 2, wherein said rebounding surface is formed on a cylindrical wall of the target element.

8. Putting stroke developer according to claim 7, wherein said target element comprises a pipe segment forming the cylindrical wall of the target element and wherein said block of material is formed as a cap for said pipe segment.

9. Putting stroke developer according to claim 8, wherein said block has a dome-shaped top portion extending upwardly from a top edge of the pipe segment.

10. Putting stroke developer according to claim 9, wherein target indicia are marked on a top surface of the dome-shaped top portion of said block to form a means for getting the line of the putt.

11. Putting stroke developer according to claim 10, wherein said indicia comprise a center line and at least one additional line at each side thereof, said center line and the additional lines running from proximate the top edge of the pipe segment to an apex of the dome-shaped top portion of the block.

12. Putting stroke developer according to claim 1, wherein said base surface is provided with surface means for improving sliding resistance.

13. Putting stroke developer according to claim 12, wherein said surface means comprises at least one of a surface texturing and a covering having a high coefficient of friction.

14. Putting stroke developer according to claim 12, wherein said surface means comprises a corrugated surface texturing.

15. Putting stroke developer according to claim 12, wherein said surface means comprises a covering of a resilient material.

16. Putting stroke developer according to claim 1, wherein said rebounding surface is formed by a partially cylindric front portion of a target body having a rectangular prismoid rear portion of a width equal to the length of the chord of the partially cylindric front portion.

* * * * *